US005842692A

United States Patent [19]

Rutishauser

[11] Patent Number: 5,842,692

[45] Date of Patent: Dec. 1, 1998

[54] COVERED FEED UNIT FOR FEEDING RECORDING MEDIA INTO AN OFFICE MACHINE

[75] Inventor: Thomas Rutishauser, Uerikon, Switzerland

[73] Assignee: Rutishauser Data AG, Switzerland

[21] Appl. No.: 686,186

[22] Filed: Aug. 1, 1996

[30] Foreign Application Priority Data

Aug. 10, 1995 [CH] Switzerland ..... 02 303/95

[51] Int. Cl.[6] ..... B65H 5/22

[52] U.S. Cl. ..... 271/3.2; 271/4.1; 271/273; 271/186

[58] Field of Search ..... 271/3.2, 3.24, 271/4.1, 186, 273, 274, 225, 162

[56] References Cited

U.S. PATENT DOCUMENTS

| | | | |
|---|---|---|---|
| 3,829,083 | 8/1974 | Shiina et al. | 271/186 X |
| 5,002,266 | 3/1991 | Kikuchi et al. | 271/3.2 |
| 5,064,188 | 11/1991 | Nagao et al. | 271/274 X |
| 5,448,340 | 9/1995 | Ogiri et al. . | |
| 5,534,989 | 7/1996 | Rubscha et al. | 271/186 X |

FOREIGN PATENT DOCUMENTS

| | | | |
|---|---|---|---|
| 114936 | 6/1986 | Japan | 271/162 |
| 138072 | 5/1990 | Japan | 271/273 |
| 319618 | 12/1993 | Japan | 271/273 |
| 72589 | 3/1994 | Japan | 271/273 |

*Primary Examiner*—Boris Milef

*Attorney, Agent, or Firm*—Tim Headley; Haynes and Boone, L.L.P.

[57] ABSTRACT

A covered feed unit (1) fits on the housing of an office machine (7), in particular, of a flat-bed scanner, having a feed opening (47) for recording media (46), and having a discharge opening which is arranged in a plane located beneath the feed opening, and which is intended for the recording media. Between the feed opening and the discharge opening, the covered feed unit (1) has a deflecting device (6) which has a drive unit (33). The covered feed unit transports the recording media (46) via a transporting path by means of driven transporting rollers (35*a*, 35*b*) and idler rollers (38), which form a clamping nip with the transporting rollers. The deflecting device (6) is enclosed by a covering. An upper cover (3) which bounds the feed opening is connected pivotally via a hinge (32) to an upper cover (5) which bounds the discharge opening. The drive unit (33), with its drive-connected transporting rollers (35*a*, 35*b*), is disposed in that end region of the upper cover (3), adjacent to the hinge (32). Idler rollers (38) are provided in the lower cover (5).

15 Claims, 6 Drawing Sheets

COVERED FEED UNIT FOR FEEDING RECORDING MEDIA INTO AN OFFICE MACHINE

BACKGROUND OF THE INVENTION

The invention relates to a covered feed unit for fitting on the housing of an office machine, in particular of a flat-bed scanner.

The covered feed units in the prior art include: a feed opening for recording media; a discharge opening which is disposed in a plane located beneath the feed opening and which is intended for the recording media; and a deflecting device. The deflecting device includes a drive unit having a protective cover over it. The drive unit transports recording media along a transporting path from the feed opening to the discharge opening by means of driven transporting rollers and idler rollers which form a clamping nip with the transporting roller. However, the drive units of the prior art are only partially accessible under the protective cover.

Such a covered feed unit is usually provided for the automatic feed of recording media in flat-bed scanners, a recording medium being sent from an upper supply magazine, via a feed opening, to a deflecting device equipped with a drive unit, then scanned by a scanning head and deposited, via a discharge opening, in a delivery magazine located beneath the supply magazine. The deflecting device has pairs of rollers which include driven transporting rollers and idler rollers which form a clamping nip with the transporting rollers. In the case of the covered feed units of the prior art, the deflecting device is arranged in an end region and is pivotally supported in the end region on the housing of the flat-bed scanner. The supply magazine and the delivery magazine are each mounted on the deflecting device via a separate hinge fastening mechanism such that they can be pivoted to a limited extent. Moreover, the deflecting device, which comprises the pairs of rollers and forms the transporting path, is, at best, partially accessible with difficulty, with the result being that it is only by expending substantial effort that it is possible to remove a recording medium which has been fed in a skewed manner or has been jammed due to insufficient separation. The disadvantage with this prior art covered feed unit is that access to the delivery magazine can be gained only with a comparatively high degree of operational downtime.

The object of the present invention is therefore to improve a covered feed unit of the above-mentioned type so as to provide straightforward operation and accessibility along with a compact design.

SUMMARY OF THE INVENTION

This object is achieved by a covered feed unit having: a feed opening for recording media; a discharge opening which is arranged in a plane located beneath the feed opening and which is intended for the recording media; and a deflecting device. The deflecting device includes a drive unit having a protective cover. The drive unit transports recording media along a transporting path from the feed opening to the discharge opening by means of driven transporting rollers and idler rollers which form a clamping nip with the transporting rollers. The covered feed unit includes an upper protective cover which bounds the feed opening, and which is connected pivotally via a hinge to a lower cover. The lower cover bounds the discharge opening, wherein further, the drive unit, with its driven transporting rollers, is disposed in that end region of the upper protective cover which faces the hinge, and idler rollers are provided in the lower cover.

By virtue of the inventive design with a drive unit integrated in the end region of the upper protective cover, the transporting rollers and the idler rollers are lifted away from one another by way of the upper protective cover being lifted or pivoted away; the clamping nip formed by these rollers is consequently opened. As a result, it is possible for the transporting path of the recording media to be released, not just partially, as in the case of the prior art, but entirely along the deflecting device. Consequently, the recording media is accessible without any obstruction over their entire transporting path through the covered feed unit. The inventive arrangement of the drive unit in the upper cover permits a more straightforward design of the covered feed unit having a minimum of components.

By virtue of the inventive design of the covered feed unit, its pivot point, moreover, can be located in the immediate vicinity of its center of gravity, as a result of which, the torque which is exerted on the fastening mechanism on the housing of the office machine is considerably smaller. Because less stress in imparted into the covered feed unit and the housing, this means that the design of the covered feed unit may be simplified further.

A more straightforward design means that it is possible to produce the covered feed unit more easily and, therefore, more cost-effectively.

In a preferred embodiment of the invention, the whole covered feed unit can be pivoted away in its entirety via a second hinge, as a result of which, the office-machine bearing plane, which is designed as a glass plate in the case of a flat-bed scanner, is accessible in the region of the scanning head by means of a single manipulation.

Further advantages follow from the dependent patent claims and from the following description, in which the invention is explained in more detail with reference to an exemplary embodiment represented in the schematic drawings.

BRIEF DESCRIPTION OF THE DRAWINGS

In the figures, in each case the same designations have been used for the same elements, and the initial explanations apply to all the figures unless expressly stated otherwise.

DESCRIPTION OF THE PREFERRED EMBODIMENT

Figure 1:
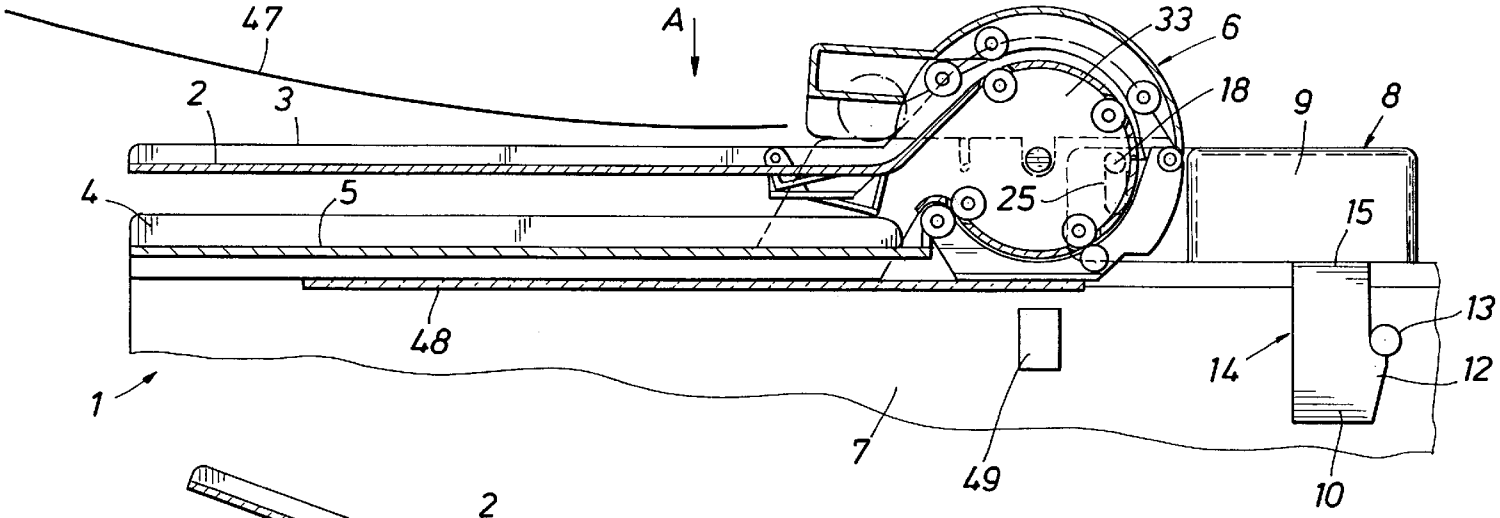
FIG. 1 shows, partly in cross-section and partly in side view, a covered feed unit in the normal operating state, fastened on a flat-bed scanner.
Figure 2:
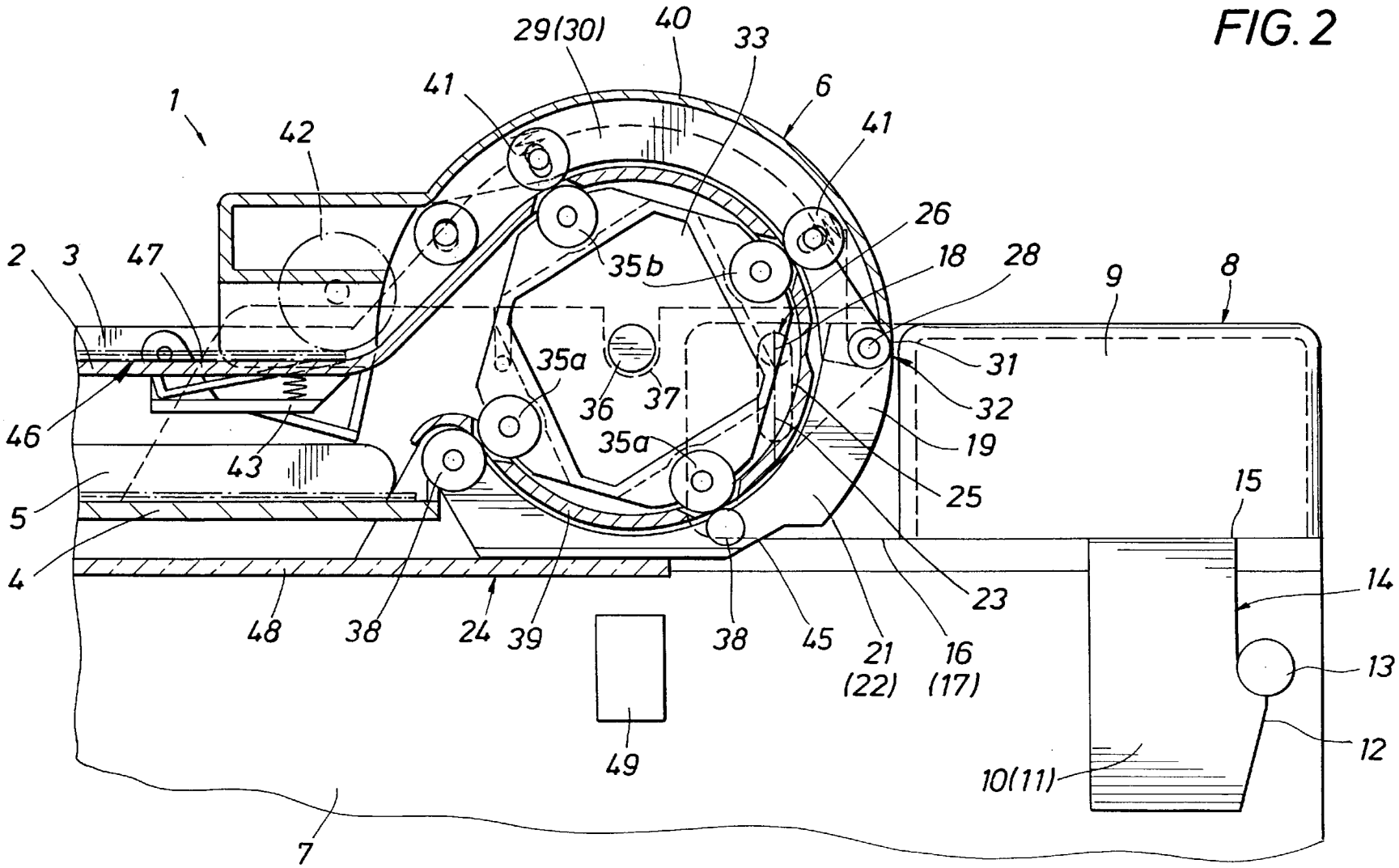
FIG. 2 shows, on an enlarged scale, part of the same covered feed unit as in FIG. 1.
Figure 3:
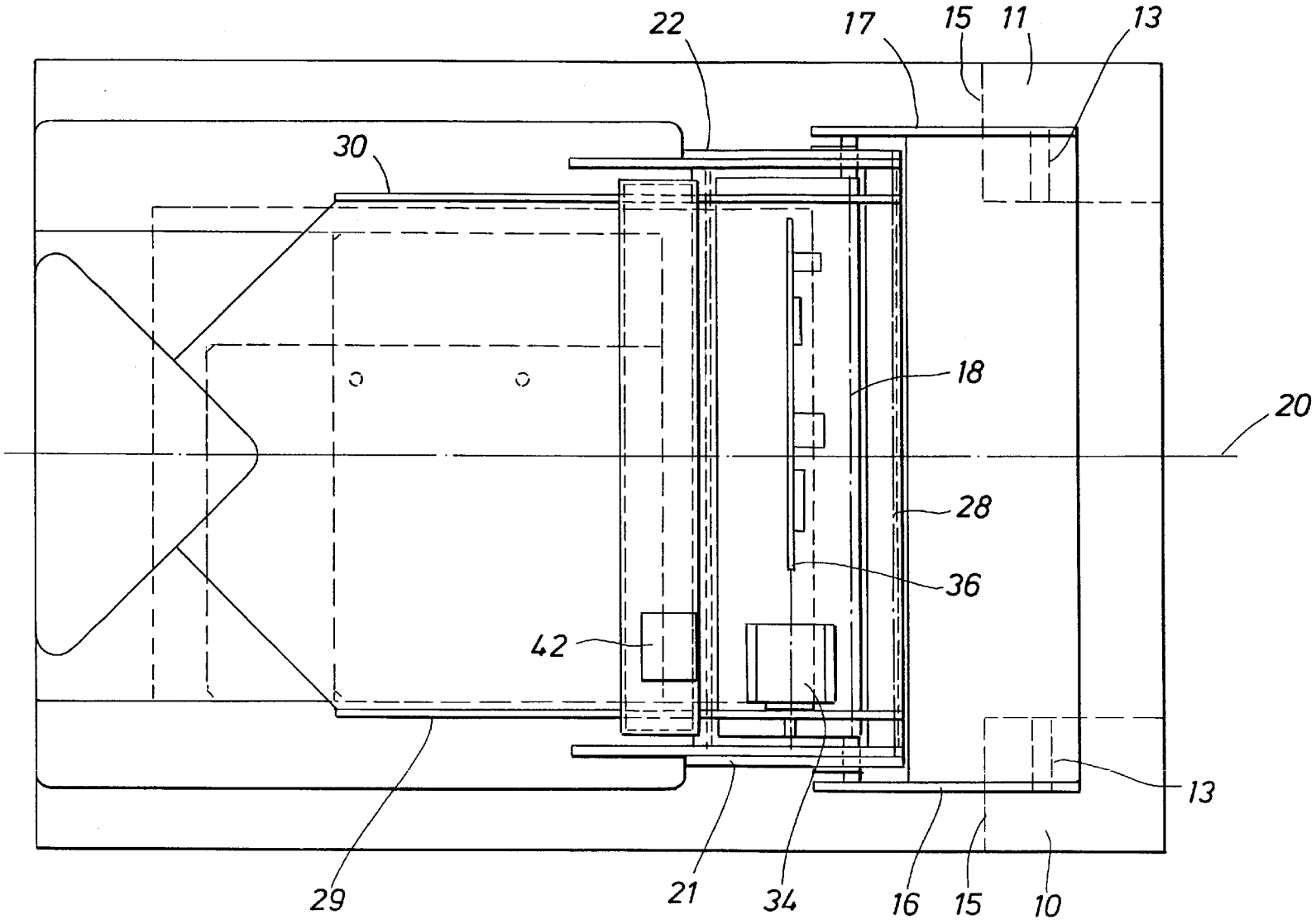
FIG. 3 shows the same covered feed unit as in FIG. 1 in plan view in accordance with the arrow A in FIG. 1.

As depicted in FIGS. 1 to 3, a three-part covered feed unit 1 includes an upper cover 3 which has a supply magazine 2, a lower cover 5, which has a delivery magazine 4, and a deflecting device 6. The upper cover 3 forms a feed opening for recording media, together with the deflecting device 6, and, together with this, the lower cover 5 forms a discharge opening for recording media. Furthermore, the covered feed unit 1 has a plug-in fastening mechanism 8 with which it is fastened on an office machine 7, in this case, a flat-bed scanner. The plug-in fastening mechanism 8 has a cuboidal hinge strip 9 which extends over the entire width of the flat-bed scanner 7 and has two pegs 10 and 11 arranged in the side region (cf. FIG. 2). The pegs 10 and 11 are each provided with a latching lug 12 which engages behind a resiliently mounted transverse pin 13 in a corresponding receiving mechanism 14 in a housing, namely, opening 15 of the flat-bed scanner 7. It can further be seen from FIGS. 1 and 2 that the hinge strip 9 is provided with two side walls 16 and 17, which project beyond a side wall 60 and between which a hinge pin 18 is fastened. Provided in the end region 19 of the lower cover 5, the end region facing the hinge strip 9, are two side parts 21 and 22 which are parallel to the side walls 16 and 17, are directed along the longitudinal center axis 20 (cf. FIG. 3) of the flat-bed scanner 7, and are offset inward toward the longitudinal center axis 20 with respect to the side walls 16 and 17. Each sidewall 16 and 17 has a slot 25 which has its longitudinal axis 23 directed toward the bearing plane 24 of the flat-bed scanner 7. When the covered feed unit 1 has been swung down on the flat-bed scanner 7, the longitudinal axis 23 forms an angle of approximately 90° with the bearing plane 24. These slots 25 thus form a first hinge 26 with the hinge pin 18 received by them.

Provided in the side parts 21 and 22 of the lower cover 5, in the end region 19, between the first hinge 26 and the hinge strip 9, is a hinge pin 28 which is articulatably connected to side parts 29 and 30, the side parts projecting beyond the upper cover 3 toward the hinge strip 9, via circular openings 31 provided in the side parts (cf. FIGS. 2 and 3). The hinge pin 28 thus forms a second hinge 32 with the openings 31 provided in the side parts 29 and 30. As a result, the upper cover 3, with its supply magazine 2, is mounted pivotally with respect to the lower cover 5, with its delivery magazine 3. Alternatively, this arrangement can be pivoted in its entirety about the hinge pin 18 of the first hinge 26 with respect to the hinge strip 9 of the plug-in fastening mechanism 8.

A drive unit 33, with a drive motor 34 and four transporting rollers 35*a* and 35, is fastened on the upper cover 3, between the side parts 29 and 30. The drive shaft 36 of the drive motor 34 which projects beyond the side parts 29 and 30, is pivotally mounted such that it can be pivoted away upward, in two cradles 37, in the side parts 21 and 22, which are part of the lower cover 5. Disposed on spindles between the side parts 21 and 22 are idler rollers 38 which form a clamping nip with the lower transporting rollers 35*a* of the upper cover 3. The cradles 37 thus form a fixed stop for the drive unit 33 after the transporting rollers 35*a* and the idler rollers 38 have been engaged for transporting purposes. Furthermore, a curved guide 39, is attached to the idler rollers 38, and includes the side parts 21 and 22 integrally formed thereto.

The first hinge 26 and the second hinge 32 are both provided in the end region 19 of the lower cover 5, the end region being adjacent the hinge strip 9, but are located as near as possible to the drive shaft 36 of the drive motor 34. This is because the drive shaft 36 itself is located very near to the center of gravity of the pivotable part of the covered feed unit 1. In a variant of the above covered feed unit 1, it is also possible for the two hinge pins 18 and 28 to be coaxial.

Articulated on the hinge pin 28 is a semi-circular covering 40, which encloses the upper transporting rollers 35*b*. Two idler rollers 41 are provided on the covering 40 and form a clamping nip with the upper transporting rollers 35*b*. Furthermore, the covering 40 has provided on it, on the side adjacent the supply magazine 2, a draw-off roller 42 which is arranged, for example, on one side of the longitudinal center axis 20. A pressing element 43 is provided in the supply magazine and interacts with the draw-off roller 42.

As can further be seen in FIG. 2, the end region 19, which is formed, inter alia, by the side parts 21 and 22, is approximately the same height as the hinge strip 9 and is rounded in the form of an arc of a circle in order to make it possible to swing up the covered feed unit 1 to different levels. This end region 19 includes a step relief on the side facing the flat-bed scanner 7 and is provided with a chamfer 45 on the lower end of the side facing the hinge strip 9.

By virtue of the above-described design, the covered feed unit 1 can be pivoted upward in its entirety by means of a single manipulation. Alternatively, it is possible to pivot the upper cover 3, together with its supply magazine 2, away from the lower cover 5, together with its delivery magazine 4, the lower transporting rollers 35*a* simultaneously being lifted away from the idler rollers 38 on the lower cover 5. As a result of which, the transporting path of the recording media 47 is also exposed in the lower region. Consequently, recording media 47, which may have jammed or have been fed askew, can be removed without difficulty over the entire transporting path. If, in the upper region of the covered feed unit 1, a recording medium 47 has been jammed between the covering 40 and the drive unit 33 with the transporting rollers 35*b*, or has been fed askew, it can likewise be removed in a simple manner by pivoting the covering 40 away, as is further illustrated in FIGS. 8 and 9.

The covers 3 and 5 are configured in a manner known in the prior art in the region of the bearing plane 24 for a stack 46 of recording media 47. Therefore, details relating to this will not be discussed here any further. As can also be seen from FIG. 1, the flat-bed scanner 7 is provided with a glass plate 48 which forms the bearing plane 24, and on which the recording medium 47 to be scanned can be positioned, the flat-bed scanner 7 scanning the recording medium, line-by-line, by means of a scanning head 49. That position of the scanning head 49 which is represented in FIG. 1 constitutes the parked position, in which the scanning head 49 is located prior to a subsequent scanning operation. However, by virtue of the covered feed unit 1 presented here, it is also possible for the recording medium 47 to be guided past the scanning head 49 by means of the deflecting device 6, with the result that scanning takes place in the parked position of the scanning head 49. For this purpose, the curved guide 39 has provided in it a longitudinal slot (not visible here) which has a transparent covering window and extends at least over the width of the recording medium 47.

The normal operation of the flat-bed scanner 7 represented here is thus given in FIG. 1 and takes place in the above-mentioned manner, i.e., the recording media 47 to be scanned are guided individually, one after the other, past the scanning head 49 until the entire stack 46 of recording media 47 has been scanned and deposited in the delivery magazine 4.

It can be readily understood from the mode of functioning of the covered feed unit 1 that the latter may also be used to scan recording media 47 of a larger format than the conventional A4 format, for example, the A3 format, as is indicated in FIG. 1, the only critical feature being the width of the scanning head 49 (and of the parts adapted to this, such as, inter alia, the supply magazine 2 together with the upper cover 3, and the delivery magazine 4 together with the lower cover 5).

Figure 4:
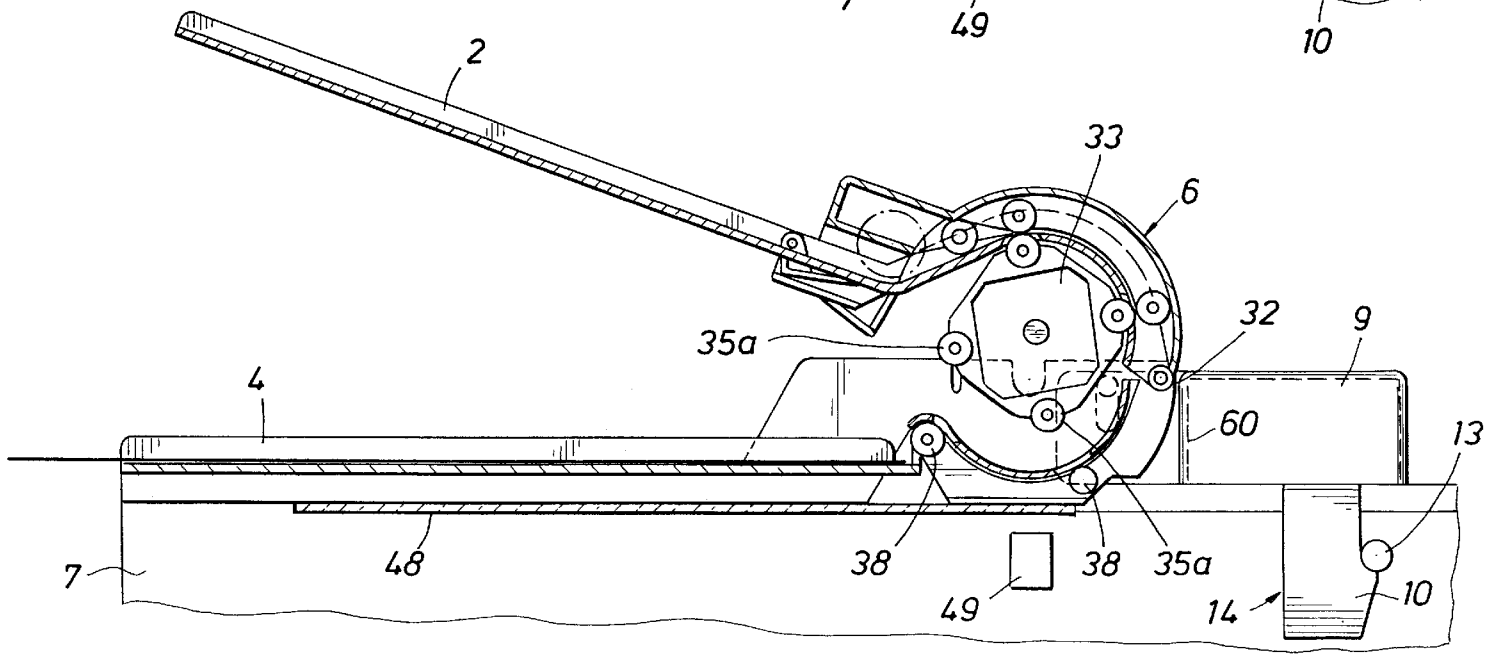
FIGS. 4 to 9 show different positions of the covered feed unit according to FIG. 1, in order to explain the operating functions.

FIG. 4 shows the supply magazine 2 in a state in which it has been lifted away from the delivery magazine 4, in order to be able to remove the scanned recording medium 47 again.

Figure 5:
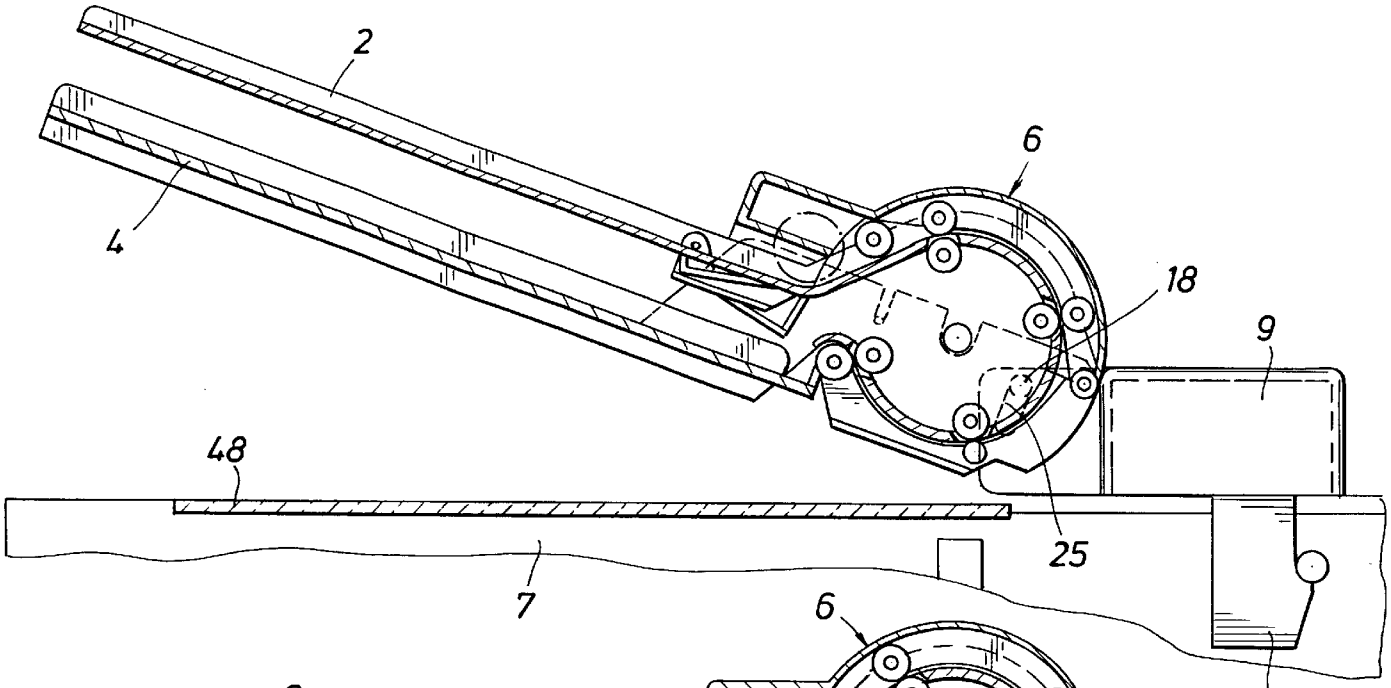

It is also possible for the covered feed unit 1 to be swung upward in its entirety according to FIG. 5, in order to position the recording medium 47 on the glass plate 48 and to bring the flat-bed scanner 7 into scanning mode.

Figure 6:
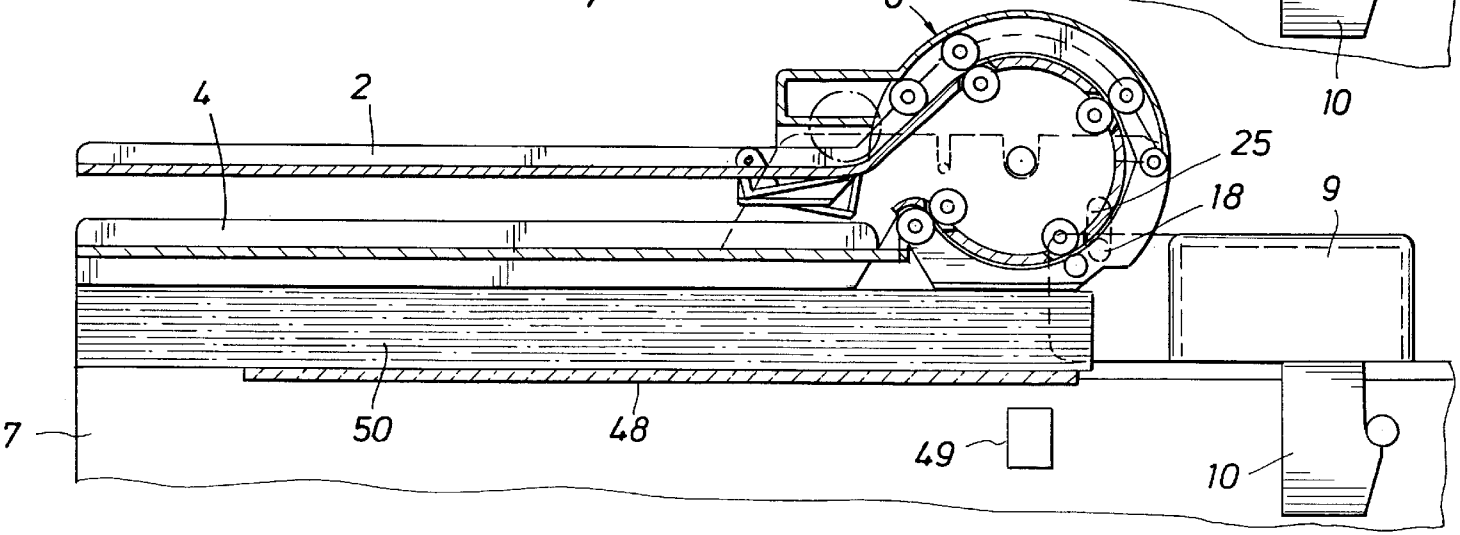

In this mode of operation, it is also possible to scan pages of books 50 with the scanning head 49, as is represented in FIG. 6. In this process, the slots 25 of the lower cover are automatically displaced upward, with the result that the hinge pin 18 is displaced downward in the slots 25. The maximum thickness of the book 50 positioned on the glass plate 48 is thus determined by the length of the slots 25. Depending on the inclination and curvature of the uneven surface of the opened book 50, the hinge pin 18 rotates about an imaginary axis running at right angles thereto, thus resulting in surface contact between the upper cover 3 and the book covers to the greatest extent possible. Within the limits determined by the dimensions of the slot 25, it is thus also possible to scan pages in the front or rear part of a book 50 using the scanning head 49 when the covered feed unit 1 is closed. In this arrangement, the dead weight of the covered feed unit 1 is usually sufficient to exert sufficient pressure on the book 50 to be scanned, and it is not necessary to exert manual pressure on the book. As can be seen from FIG. 6, the chamfer 45, in the form of a step relief, is used in order to be able to roll the covered feed unit 1 along a book edge, with the result that the book 50 is not damaged when it is positioned on the scanner or removed therefrom.

Figure 7:
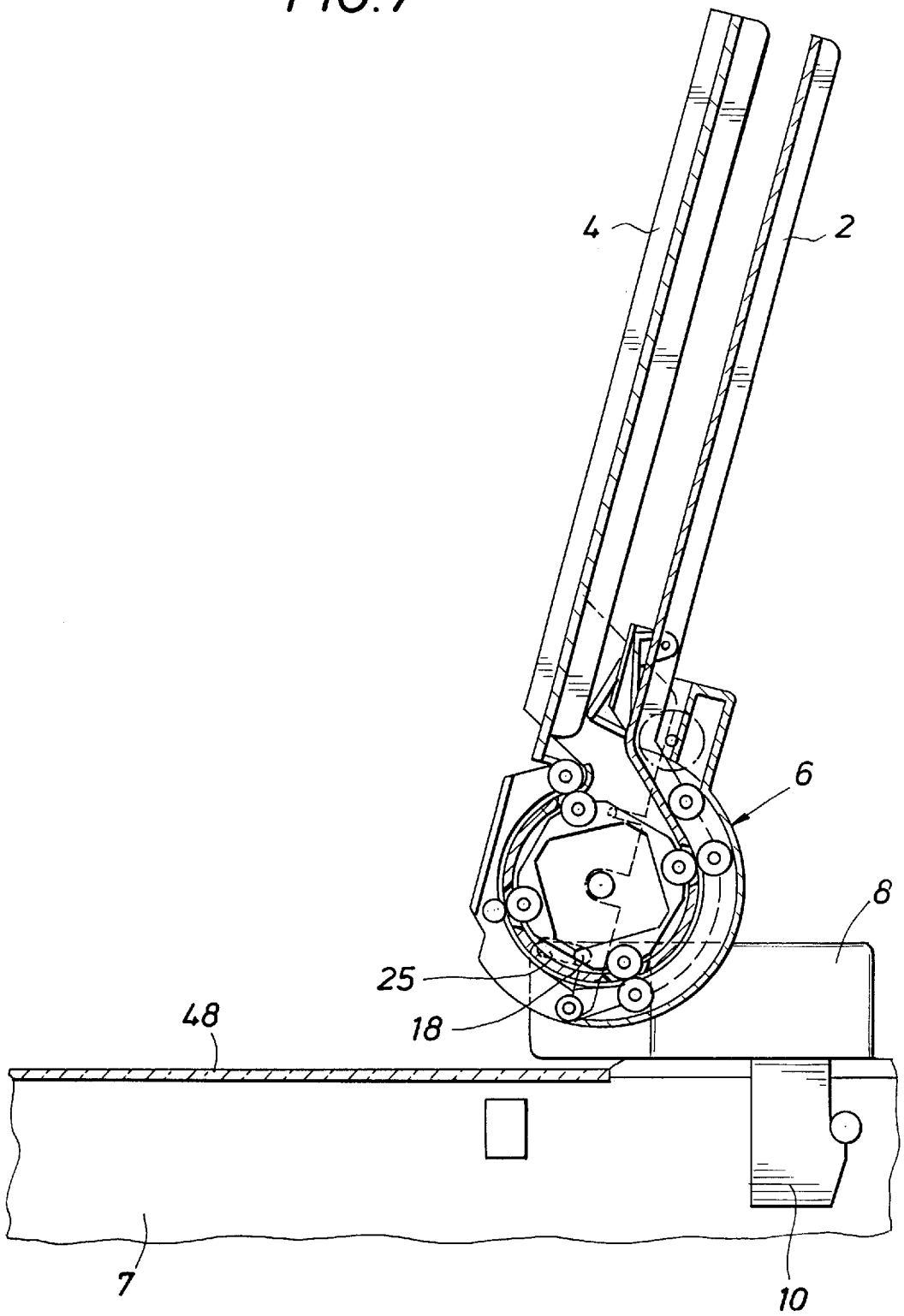

FIG. 7 represents the covered feed unit 1 in a state in which it has been pivoted open to the full extent. This is normally the case when the flat-bed scanner 7 is not in use.

Figure 8:
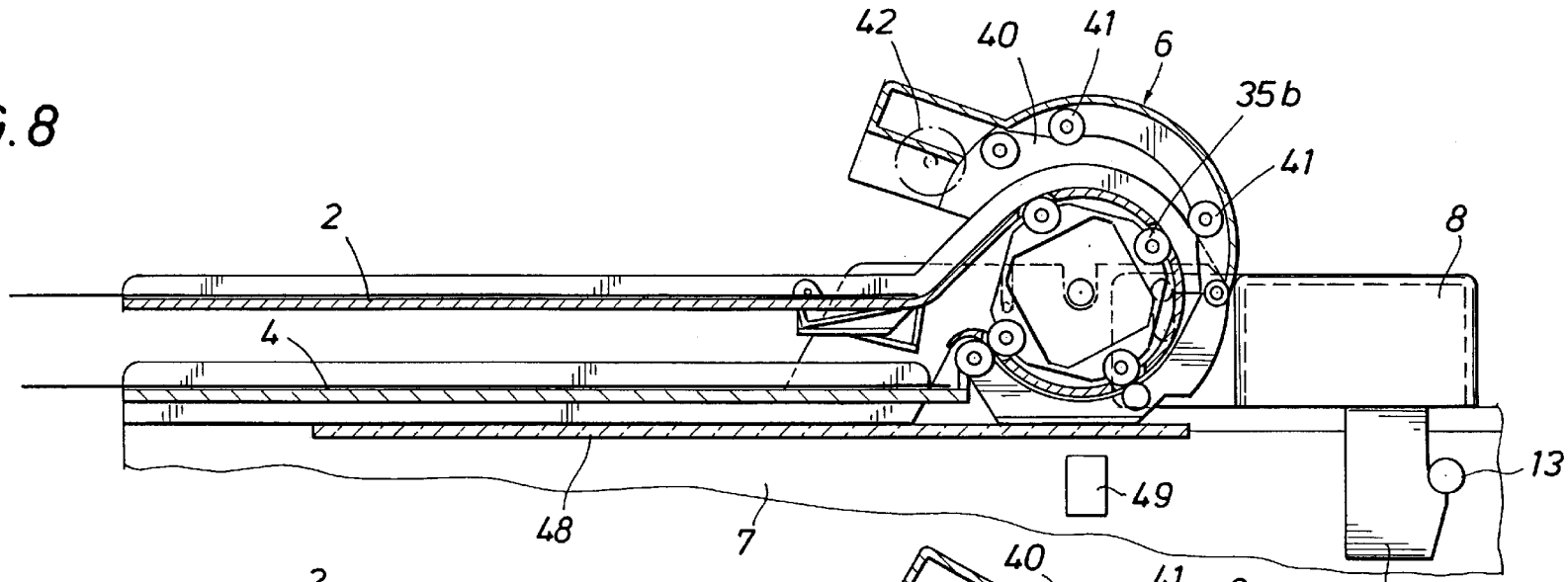
Figure 9:
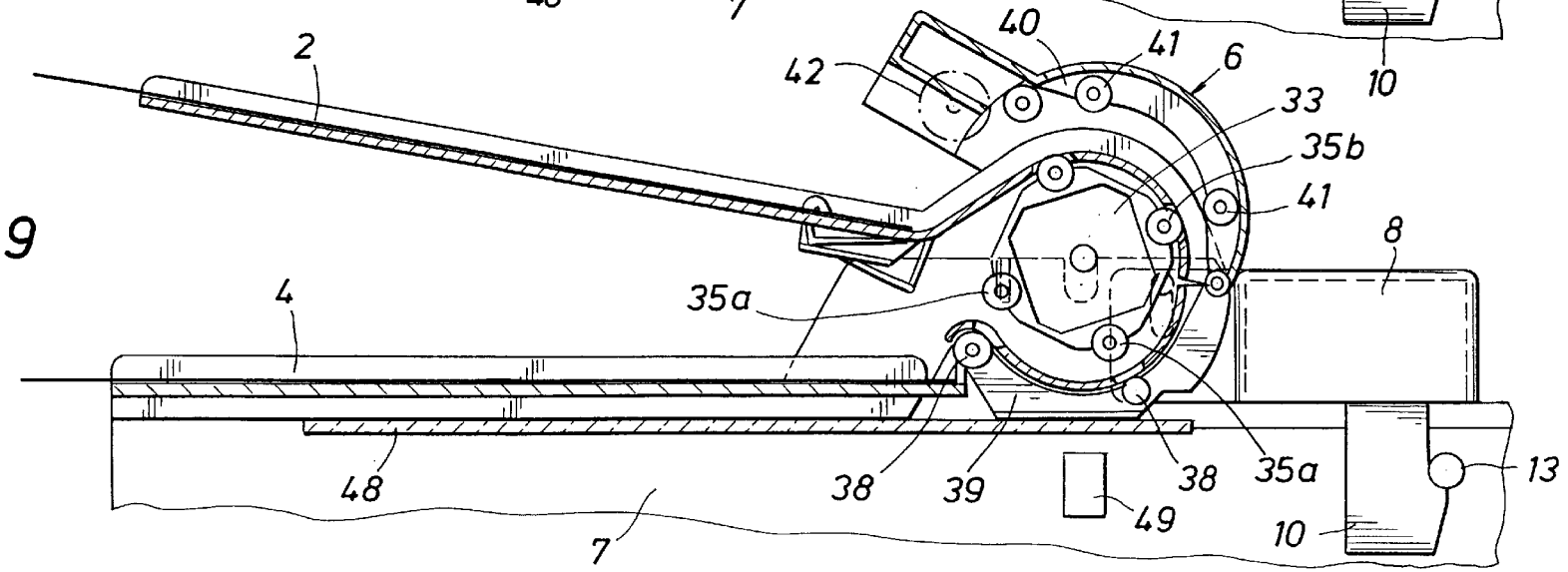

FIG. 8 depicts the ability of removing a recording medium 47 which has become jammed or has been fed askew between the supply magazine 2 and the deflecting device 6 in the region of the covering 40. FIG. 9 depicts the ability of removing the recording medium 47 which has become jammed between the delivery magazine 4 and the deflecting device 6 in the region of the curved guide 39. It can easily be seen from this that the idler rollers 41 are lifted away from the transporting rollers 35b (FIG. 8) or the transporting rollers 35*a* are lifted away from the idler rollers 38 (FIG. 9), thus exposing the transporting path of the recording media 47. Therefore, every critical point of the drive unit 33 is accessible by means of a single manipulation and each recording medium 47 which has been jammed or fed askew can be readily removed. In addition, consequently, the operator can carry out regular and/or straightforward cleaning and maintenance procedures, for example the cleaning of the covering window above the scanning head 49, which results in reduced effort and thus a further cost saving.

Instead of being in the side walls 16 and 17, it is also possible for the slots 25 which have been described in conjunction with FIGS. 1 to 3 to be disposed in the lower cover 5. In this case, the hinge pin 18 is provided on the upper cover 3, which means that the hinge pin 18 should be located at the bottom of the slot 25 during normal operation. It is also possible for the longitudinal axes 23 of the slots 25 to form, with the bearing plane 24, an angle which is slightly smaller or greater than 90°, in order to provide for lateral displacement in addition to vertical adjustment of the lower cover 5. Also, it is not absolutely necessary for the hinge pin 18 to be continuous; alternatively, two short pins and longitudinal slots may be provided in the side walls 21 and 22 of the lower cover 5 and in the hinge strip 9. It is also possible for a single continuous slot 25 to be provided in the end region 19 of the upper cover 5.

The above described covered feed unit 1 is of a particularly compact and straightforward design, thus also resulting in more straightforward and cost-effective assembly. Since, in comparison with the conventional solutions, the covered feed unit 1 can be configured and assembled in a particularly straightforward manner using a small number of components, many quality control requirements as regards the end product are more easily fulfilled.

Instead of being used on a flat-bed scanner 7, it is also possible for the abovementioned covered feed unit 1 to be used for other office machines, such as a copier, fax machine or laser printer.

I claim:

1. A covered feed unit (1) for fitting on the housing of an office machine (7), the covered feed unit comprising:

a feed opening for receiving recording media (47);

a discharge opening which is disposed in a plane located beneath the feed opening for discharging the recording media (47); and a deflecting device (6) having a covered drive unit (33) which transports the recording media (47) along a transporting path from the feed opening to the discharge opening by means of driven transporting rollers (35*a*, 35*b*), and pressure-exerting idler rollers (38) which form a clamping nip with the transporting rollers, wherein:

an upper cover (3), which bounds the feed opening, and which upper cover is connected pivotally via a first hinge (32) to a lower cover (5) which bounds the discharge opening wherein the first hinge (32) defines a pivot axis; and wherein the driven transporting rollers, (35*a*, 35*b*), are disposed in that end region of the upper cover (3) which is adjacent to the hinge (32); and the pressure-exerting idler rollers (38) are provided in that end region of the lower cover (5) which is adjacent to the hinge (32); and wherein the pivot axis defined by the first hinge is transverse to the transporting path.

2. The covered feed unit as claimed in claim 1, wherein the transporting path runs around the drive unit (33), and wherein the upper cover (3) is supported on the lower cover (5) by means of fixed stops (37) when the transporting rollers (35*a*) rest against the pressure-exerting idler rollers (38).

3. The covered feed unit as claimed in claim 2, wherein a drive shaft (36) of the drive unit (33) pivotally mounts on the lower cover (5).

4. The covered feed unit as claimed in claim 1 wherein the unit further comprises a plug-in fastening mechanism (8) sized to be received in an opening (15) in the office machine housing which mechanism is pivotally mounted to the lower cover (5) via a second hinge (26).

5. The covered feed unit as claimed in claim 4 wherein the second hinge (26) includes a hinge pin (18) which is mounted in at least one slot (25), the longitudinal axis (23) of which is directed toward a bearing plane (24) of the office machine.

6. The covered feed unit as claimed in claim 1, wherein the lower cover (5) has a curved guide (39) which interacts with the pressure-exerting idler rollers (38).

7. The covered feed unit as claimed in claim 1, wherein a covering (40) is connected pivotally to the upper cover (3) via the first hinge and has pressure-exerting idler rollers (41) which form a clamping nip with the transporting rollers (35*b*).

8. The covered feed unit as claimed in claim 7, wherein, upstream of the pressure-exerting rollers (41) of said covering (40) alone the transporting direction, the covering (40) has a draw-off roller (42).

9. A covered feed unit (1) as claimed in claim 1 wherein the unit further comprises a plug-in fastening mechanism (8)

sized to be received in an opening (15) in the office machine housing which mechanism is pivotally mounted to the upper cover (3) via a second hinge (26).

10. The covered feed unit as claimed in claim 9, wherein the second hinge comprises a hinge pin (18) fastened between side walls (16, 17) of the covered feed unit (1).

11. The covered feed unit as claimed in claim 10, wherein the hinge pin (18) is disposed in the plug-in fastening mechanism (8) and a slot (25) for receiving the hinge pin is disposed in the cover (3, 5).

12. The covered feed unit as claimed in one of claims 9 to 11, wherein the lower cover (5) includes an end region (19) which faces the second hinge (26), and a portion of the lower cover is in the form of an arc of a circle.

13. The covered feed unit as claimed in claim 12, wherein the end region (19) of the lower cover (5) has a flattened side facing a bearing plane (24) of the office machine.

14. The covered feed unit of claim 13, wherein the flattened side of the end region (19) is provided with a chamfer (45), adjacent the hinge (26), in the form of a step relief.

15. The covered feed unit as claimed in claim 9 wherein the second hinge (26) includes a hinge pin (18) which is mounted in at least one slot (25), the longitudinal axis (23) of which is directed toward a bearing plane (24) of the office machine.

* * * * *

UNITED STATES PATENT AND TRADEMARK OFFICE

CERTIFICATE OF CORRECTION

PATENT NO. : 5,842,692

DATED : December 1, 1998

INVENTOR(S) : Thomas Rutishauser

It is certified that error appears in the above-identified patent and that said Letters Patent is hereby corrected as shown below:

Col. 5, line 64, "alone" should be --along --.

Signed and Sealed this

Sixteenth Day of May, 2000

*Attest:*

Q. TODD DICKINSON

*Attesting Officer*

*Director of Patents and Trademarks*